US011407080B2

(12) United States Patent
Kley et al.

(10) Patent No.: US 11,407,080 B2
(45) Date of Patent: Aug. 9, 2022

(54) VIBRATION POLISHING DEVICE

(71) Applicant: ATM GmbH, Mammelzen (DE)

(72) Inventors: Michael Kley, Birnbach (DE); Matthias Höfer, Katzwinkel (DE)

(73) Assignee: ATM GmbH, Mammelzen (DE)

( * ) Notice: Subject to any disclaimer, the term of this patent is extended or adjusted under 35 U.S.C. 154(b) by 709 days.

(21) Appl. No.: 16/330,403

(22) PCT Filed: Sep. 5, 2017

(86) PCT No.: PCT/EP2017/072199
§ 371 (c)(1),
(2) Date: Mar. 5, 2019

(87) PCT Pub. No.: WO2018/046480
PCT Pub. Date: Mar. 15, 2018

(65) Prior Publication Data

US 2021/0276142 A1 Sep. 9, 2021

(30) Foreign Application Priority Data

Sep. 6, 2016 (DE) ..... 10 2016 116 676.6

(51) Int. Cl.
*B24B 31/073* (2006.01)
*B24B 31/06* (2006.01)
(Continued)

(52) U.S. Cl.
CPC ..... *B24B 31/073* (2013.01); *B24B 31/06* (2013.01); *B24B 31/12* (2013.01); *B24B 49/10* (2013.01); *B24B 49/16* (2013.01)

(58) Field of Classification Search
CPC ..... B24B 31/027; B24B 31/06; B24B 31/067; B24B 31/073; B24B 31/12; B24B 49/10; B24B 49/16
(Continued)

(56) References Cited

U.S. PATENT DOCUMENTS 3,552,593 A * 1/1971 Szopo ..... B65D 21/0234 220/4.21
3,978,622 A * 9/1976 Mazur ..... B24B 37/102 451/270
(Continued)

FOREIGN PATENT DOCUMENTS

DE 1171303 B 5/1964
DE 102004034481 A1 2/2006
(Continued)

OTHER PUBLICATIONS

English Translation of International Preliminary Report on Patentability, Int. Serial No. PCT/EP2017/072198, Int. Filing Date: Sep. 5, 2017, Applicant: ATM GmbH, dated Mar. 21, 2019.
(Continued)

*Primary Examiner* — Eileen P Morgan
(74) *Attorney, Agent, or Firm* — Reising Ethington P.C.

(57) ABSTRACT

The present disclosure relates to a vibration polishing device, comprising:

a vibration drive for generating an oscillating vibration for polishing samples;

a polishing disc which is connected to and can be driven by the vibration drive; and a polishing bowl which is designed to receive a polishing medium and the samples to be polished and is coupled to the polishing disc for being entrained therewith;

wherein the vibration drive comprises a base part, a counter-oscillating part, a vibration plate, and drive parts, for driving in an oscillating manner the counter-oscillating part and the vibration plate against the force of leaf springs.

12 Claims, 10 Drawing Sheets

(51) Int. Cl.
*B24B 31/12* (2006.01)
*B24B 49/10* (2006.01)
*B24B 49/16* (2006.01)

(58) Field of Classification Search
USPC ..... 451/32, 35, 104, 113, 326, 327, 328
See application file for complete search history.

(56) References Cited

U.S. PATENT DOCUMENTS

| | | | | |
|---|---|---|---|---|
| 4,916,865 | A * | 4/1990 | DeSpain | B24B 31/064 451/104 |
| 4,991,360 | A * | 2/1991 | DeSpain | B24B 31/003 451/104 |
| 5,109,633 | A * | 5/1992 | Durnil | B24B 31/062 451/326 |
| 7,143,891 | B2 * | 12/2006 | Kumeth | B65G 27/02 198/757 |
| 2006/0016667 | A1 * | 1/2006 | Kumeth | B65G 27/30 198/757 |

FOREIGN PATENT DOCUMENTS

| | | | |
|---|---|---|---|
| DE | 102009044234 | A1 | 5/2011 |
| EP | 2638992 | A1 | 9/2013 |
| GB | 1018759 | | 2/1966 |
| JP | S4814689 | Y1 | 4/1973 |
| JP | S58202764 | A | 11/1983 |
| JP | 5123997 | B2 | 1/2013 |
| WO | 2006/061612 | A1 | 6/2006 |

OTHER PUBLICATIONS

English Translation of International Preliminary Report on Patentability, Int. Serial No. PCT/EP2017/072199, Int. Filing Date: Sep. 5, 2017, Applicant: ATM GmbH, dated Mar. 21, 2019.

International Search Report, Int Serial No. PCT/EP2017/072199, Int. Filing Date: Sep. 5, 2017, Applicant: ATM GmbH, dated Apr. 9, 2018.

Partial International Search Report, Int. Serial No. PCT/EP2017/072199, Int. Filing Date: Sep. 5, 2017, Applicant: ATM GmbH, dated Nov. 27, 2017.

Japanese Office Action Report with English Translation, Patent Application No. 2019-533681, dated Mar. 4, 2020, Dispatch No. of Office Action: 081178.

Japanese Office Action Report with English Translation, Patent Application No. 2019-533682, dated Mar. 4, 2020, Dispatch No. of Office Action: 081179.

* cited by examiner

VIBRATION POLISHING DEVICE

FIELD

The present disclosure relates to a vibration polishing device comprising a vibration drive for generating an oscillating vibration in an orbital motion for displacing samples to be polished, a polishing disc which is firmly connected to and can be driven by the vibration drive, and a polishing bowl which is designed to receive a polishing medium and the samples to be polished and which is coupled to the polishing disc for being entrained therewith.

BACKGROUND AND GENERAL DESCRIPTION

Such a vibration polishing apparatus has become known from U.S. Pat. No. 3,137,977 and comprises a revolving motor which drives eccentric weights and thereby causes vibration of the casing thereof. The casing is connected to a drive plate which is permanently connected, through rubber-elastic elements, to a bowl-like component which is supported on a table top or the like, through a base housing. A vibratible platen is integrated in the apparatus in a per se not disassemblable manner and can be frictionally locked to the drive plate by a knob, to follow the vibrations thereof. The vibratible platen is provided with a polishing means or polishing cloth and has an annular rim so that it can be considered as a polishing bowl. The samples to be polished are placed in the polishing bowl using a sample holder and, as a result of the vibrations caused by the imbalance drive, undergo an orbital movement during operation and at the same time a rotational movement. However, such an imbalance drive emits strong detrimental vibrations to the supporting environment of the vibration polishing apparatus. Furthermore, a replacement of the polishing platen which forms a polishing bowl is only possible through cumbersome and time-consuming disassembly of the apparatus.

The present disclosure provides a vibration polishing device which emits little or no detrimental vibrations to the environment where the device is supported.

Another aspect of the present disclosure includes to design a polishing bowl which is intended to receive a polishing medium and the samples to be polished such that the polishing bowl can be easily removed from the vibration polishing device and can be simply replaced by another polishing bowl, optionally with a different polishing medium.

In accordance with the present disclosure, the subject matter is provided in the independent claims. Refinements of the present disclosure are defined in the dependent claims.

Specifically, a vibration drive is provided for generating an oscillating vibration for an orbital motion of samples to be polished, and the vibration drive, as a unit, drives an additional polishing disc to which it is firmly connected. A polishing bowl is placed on the polishing disc and coupled thereto for being entrained therewith. The polishing bowl is designed to receive a polishing medium and the samples to be polished. As usual, the samples to be polished may be accommodated in sample holders.

A special feature is the use of a vibration drive comprising a fixed base part and two device parts which are driven oppositely to each other, defining a counter-oscillating part and a vibration plate. The vibration plate is firmly connected to a polishing disc, and a polishing bowl for receiving a polishing medium and the samples to be polished is detachably coupled to the polishing disc.

The vibration plate and the device parts connected or coupled thereto form an inertial mass that is driven into one rotational direction, and the counter-oscillating part with device parts coupled thereto form another inertial mass that is driven into the other rotational direction, so that the overall mass center remains in principle at a constant location when the device is in operation, and so that there will be no vibration excitation occurring on the fixed base part. As a result, an extraordinarily smooth running of the vibration polishing device is achieved, while in the prior art strong oscillatory vibrations are emitted to the environment.

The driving of the vibration plate and of the counter-oscillating part is effected against the force of leaf springs. The inertial mass of the vibration plate and the device parts connected or coupled thereto define a first oscillating system, and the inertial mass of the counter-oscillating part together with device parts coupled thereto define a second, counteracting oscillating system. Each of these vibration systems may exhibit their own resonance frequencies. When resonant frequencies occur, the smooth running of the vibration polishing device is disturbed. This disturbance can be detected by an acceleration sensor, and the signals thereof are fed back to a control unit of the vibration polishing device to be processed there to come out of the disturbed operation.

The oscillating vibration preferably results in an intermittent obliquely upward tangential movement of the samples to be polished with respect to the circulation of the samples within the polishing bowl, and so in particular causes the samples to perform a displacing orbital movement in a bouncing manner within the polishing bowl relative to the polishing medium, which causes the samples to slide on the polishing medium and to be polished on the underside thereof.

As a polishing medium, a polishing cloth and polishing agent in the form of a suspension are preferred. Other polishing media are also useful, for example fine abrasive, or fine abrasive paper and/or polishing paper.

For coupling the polishing bowl to the polishing disc, magnetic adhesion of the polishing bowl to the polishing disc is preferred, whereby an easily detachable vertical or axial magnetic attachment of the polishing bowl on the polishing disc is achieved.

A magnetic plate or magnetic layer may be glued to the upper side of the polishing disc or to the underside of the polishing bowl. A sheet steel disc or magnetic foil disc may be glued to the underside of the polishing bowl or to the upper side of the polishing disc. This is a simple but effective method of releasable attachment.

In addition to the magnetic coupling, positively fitting laterally effective form-fit engagement portions may be provided, defining centering and indexing means and preferably comprising a centering hub and indexing pins to achieve centering and indexing of the polishing bowl.

The polishing bowl is preferably made of a plastic material and has a carrier material for a separately handled polishing agent on the bottom inner surface. The carrier material may be a polishing cloth. The polishing bowl has a circumferential lateral wall with a groove that extends above the base wall of the polishing bowl at a height level corresponding to the thickness of the carrier material and which accommodates a rubber-elastic ring which pinches the carrier material against the bottom of the polishing bowl thus preventing polishing agent suspension from penetrating below the carrier material.

In accordance with the present disclosure, the polishing bowl is designed as a container for the polishing cloth and polishing agent suspension and can be closed tightly with a lid, and it is equipped with a carrying handle so that it can be placed on the polishing disc or lifted from the polishing disc as a container or a closed vessel. Thus, a plurality of polishing bowls or containers may be provided for a vibration polishing device, which can be easily changed on the polishing device, and which have a specification that is easily recognizable by labelling. The polishing bowls or containers are suitably designed to be stackable. For the polishing work to be performed, different polishing bowls or containers with different grades of granulation of the polishing agent can be used successively, without causing complications in the processing of the samples to be polished. Namely, the samples may be cleaned between the individual processing steps in order to avoid carryover of polishing medium of different granulation between individual containers. Apart from that, the containers are easy to clean.

As to the configuration of the vibration drive, the vibration plate is fixed to the polishing disc by screwing. The base part and the counter-oscillating part have an annular or disc-like shape and are coupled by first leaf springs. These leaf springs extend according to radial helical surfaces around the central axis of the device and control the rotational oscillatory movements of the counter-oscillating part relative to the base part.

The vibration plate of the vibration drive is coupled to the base part by second leaf springs which extend according to radial helical surfaces around the central axis of the device, like the first leaf springs. An electromotive drive is arranged between the counter-oscillating part and the vibration plate and preferably comprises a magnetic coil or a solenoid on the counter-oscillating part and a magnetic armature on the vibration plate to produce oppositely oscillating rotational oscillatory movements between this counter-oscillating part and the vibration plate, by switching on and off the solenoid, so that the magnetic armature tensions or relaxes the leaf springs. In this case, the vibration plate lifts off a little from the counter-oscillating part when the leaf springs are tensioned by the drive, and when the drive is briefly switched off, the vibration plate moves back onto the counter-oscillating part. By periodically switching on and off the drive, it is thus possible to generate a rotational oscillatory movement of the vibration plate relative to the counter-oscillating part.

The vibration drive with the base part, the counter-oscillating part, and the vibration plate, which are coupled in pairs by the first and second leaf springs, permit to balance oscillation forces such that little vibration energy is emitted to the environment, compared to an imbalance drive as in prior art vibration polishing devices.

Since with the vibration polishing device the inertial masses oscillate in opposite directions, the center of gravity remains approximately at rest, so that the supporting forces onto the stand of the vibration polishing device remain approximately constant and hardly any vibrations are emitted to the environment. Thus, extraordinarily smooth running is achieved with the vibration polishing device according to the present disclosure.

BRIEF DESCRIPTION OF THE FIGURES

An exemplary embodiment will now be described with reference to the drawings, wherein.

DETAILED DESCRIPTION OF THE EMBODIMENTS

The main parts of the vibration polishing device include a vibration drive 1, a polishing disc 2, and a polishing bowl 3. In addition, the device also comprises a control unit 4 and a protective housing.

Figure 4:
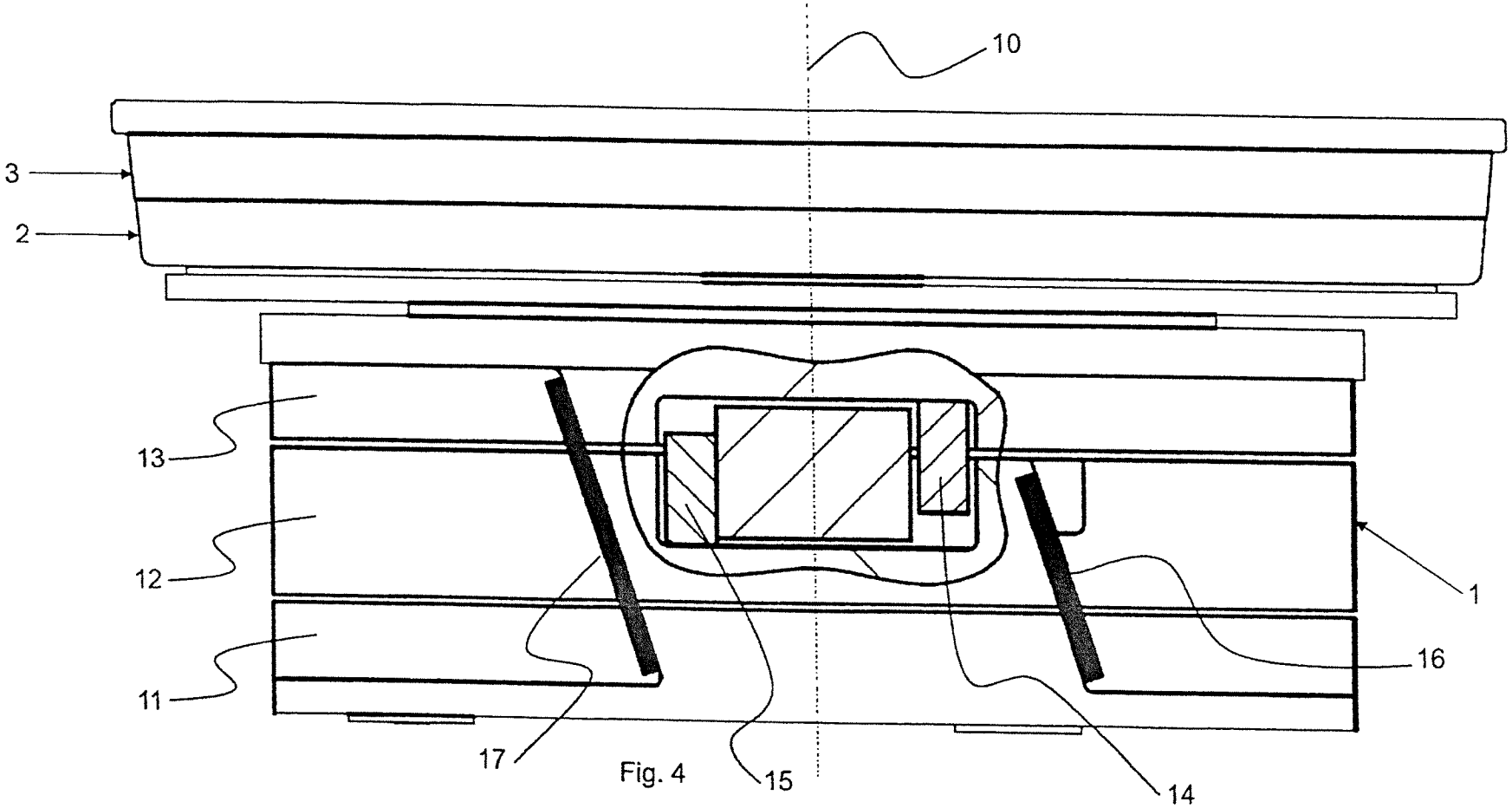
FIG. 4 shows a partially sectional side view of a vibration drive.

The electromotive vibration drive 1 (FIG. 4) comprises an annular or disc-shaped base part 11, an annular or disc-shaped counter-oscillating part 12, a vibration plate 13, and an electromotive drive with a first drive part 14 and a second drive part 15. The base part 11 is coupled to the counter-oscillating part 12 by first leaf springs 16. Furthermore, the base part 11 is coupled to the vibration plate 13 by second leaf springs 17. Each of leaf springs 16 and 17 form three spring packs which are arranged in a distributed manner around the circumference of the device. A central axis or axis of symmetry 10 can be associated with the vibration drive 1, and the leaf springs 16 and 17 form very steep helical surfaces relative to this axis, like thread sections of a multi-thread screw, which extend radially to the central axis 10 and at an inclination angle of 18° relative to the central axis 10. The structure of vibration drive 1 has been described in detail in DE 10 2004 034 481 B4 or U.S. Pat. No. 7,143,891 B2, to which reference is hereby made and which are hereby incorporated by reference into the subject matter of the present disclosure.

Figure 1:
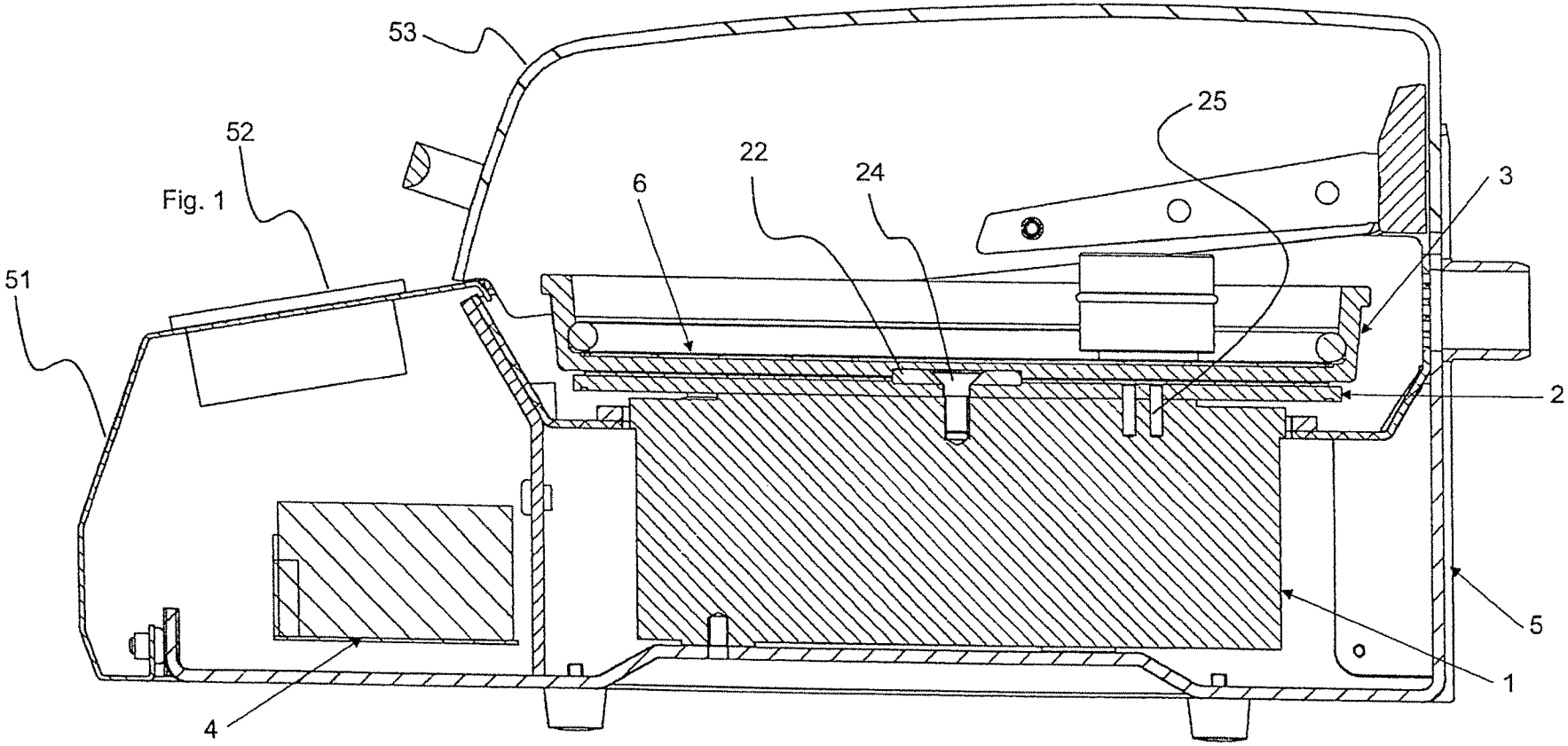
FIG. 1 shows a schematic longitudinal sectional view through a vibration polishing device.
Figure 2:
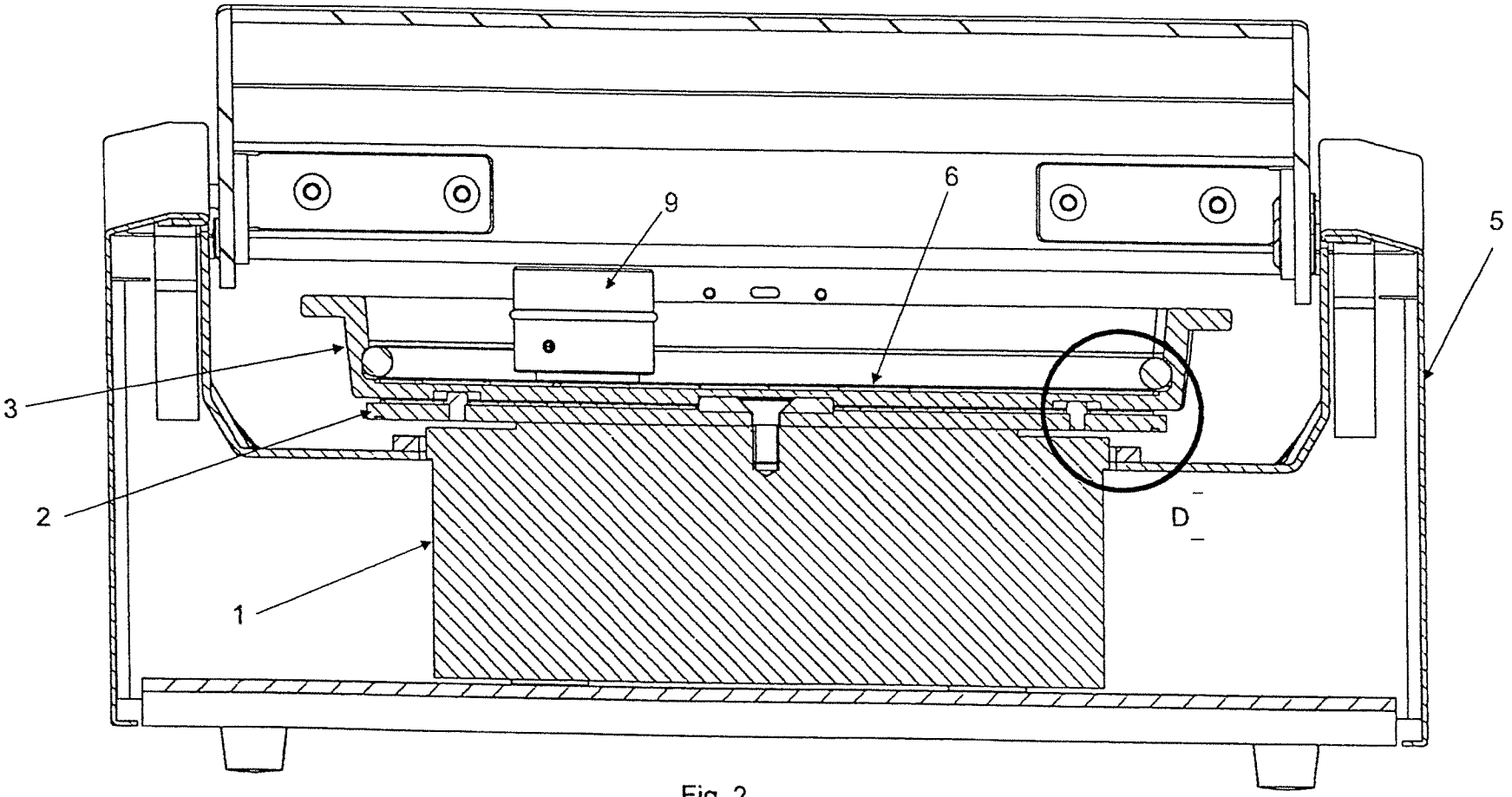
FIG. 2 shows a schematic cross-sectional view through the vibration device.

As shown in FIGS. 1 and 2, the polishing disc 2 is firmly connected to the vibration drive 1, namely by being screwed to the vibration plate 13 at 24 and indexed at 25. On its upper side, the polishing disc 2 has a magnetic plate or a magnetic sheet 21 (FIG. 3), as a first ferromagnetic layer, which is secured on the upper side of the polishing disc 2, in the present example glued thereto. Head bolts 23 which engage in engagement openings 33 of the polishing bowl 3 can be regarded as form-fitting engagement portions of a quick-type coupling.

The polishing bowl 3, preferably made of plastics, is coupled with the polishing disc 2 for being entrained therewith, and for this purpose it has a magnetic foil sheet or sheet steel disc 31 on its underside, as a second ferromagnetic layer, which may be glued to the underside of the polishing bowl 3. When the polishing bowl 3 is placed on the polishing disc 2, the ferromagnetic layers cooperate to couple the polishing bowl 3 to the polishing disc 2, whereby the polishing bowl 3 is entrained in the oscillating vibration of the polishing disc 2.

The polishing disc 2 is fixed on the upper side of the vibration plate 13 by a central screw 24 and a centering disc 22 and is indexed by eccentrically arranged indexing pins 25.

The centering disc 22 engages in a central recess 32 in the base wall of polishing bowl 3 in order to center the polishing bowl 3. Likewise, head bolts 23 engage in corresponding base wall recesses 33 of the polishing bowl 3 to provide a positive fit against rotation between the vibration drive 1 or polishing disc 2 relative to the polishing bowl 3.

Figure 5:
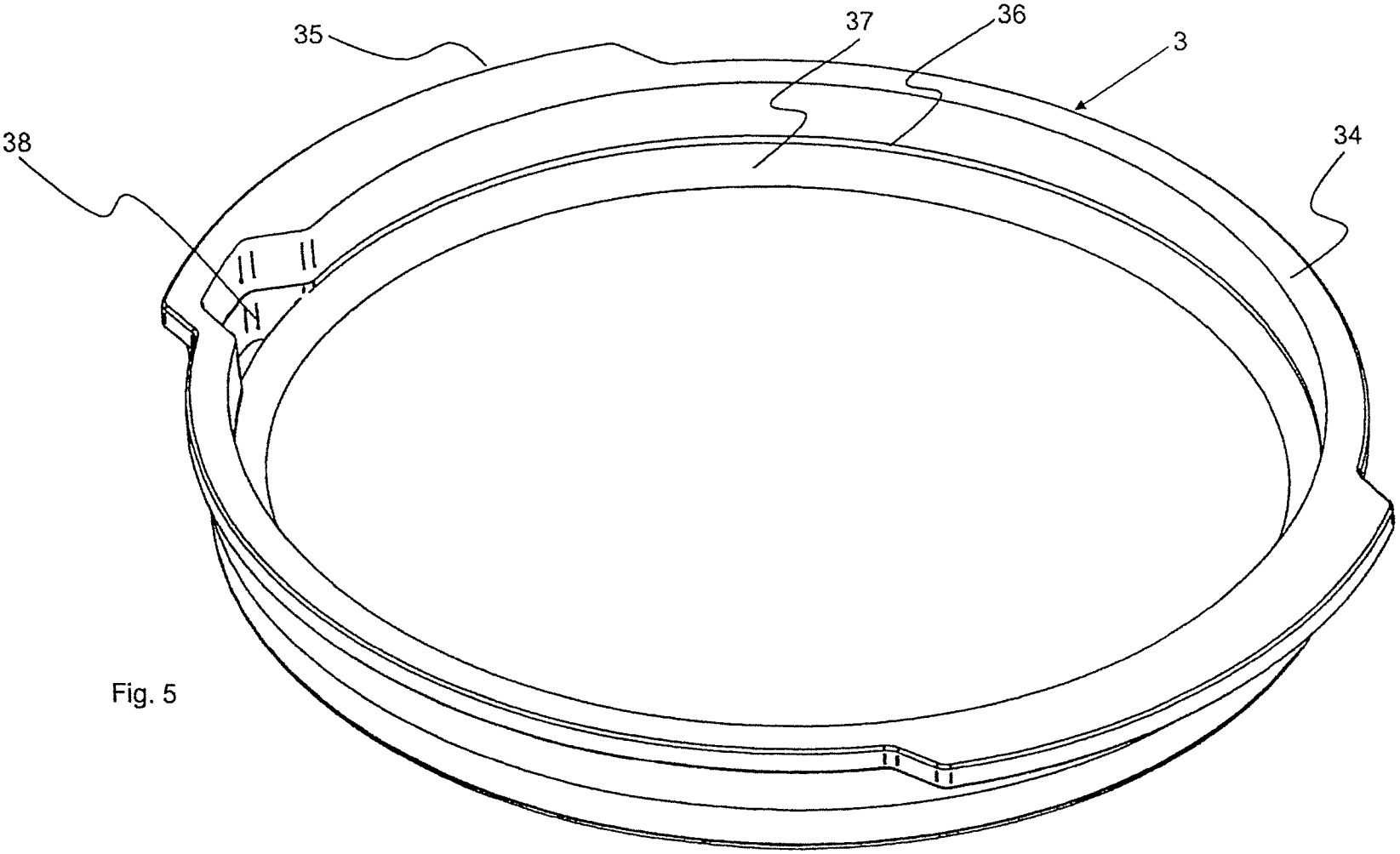
FIG. 5 is a perspective view from above of a polishing bowl.
Figure 6:
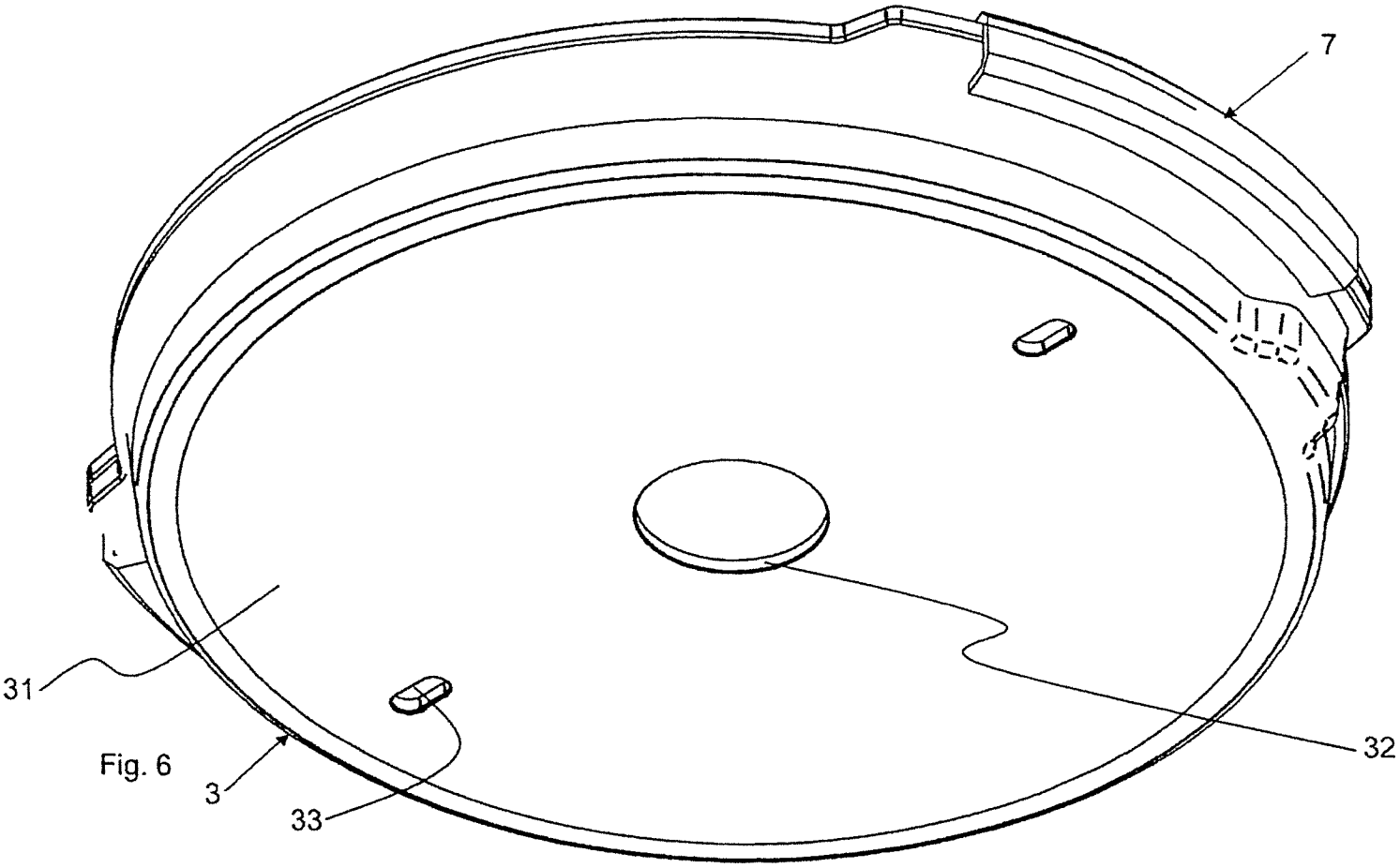
FIG. 6 is a perspective view from below of a polishing bowl.

FIGS. 5 and 6 are perspective views illustrating the polishing bowl 3 and showing the sheet steel disc 31 at the underside of the base wall. The polishing bowl 3 has a lateral wall 34 with carrying handle 35 attached thereto. As can be seen from FIGS. 3 and 5, lateral wall 34 has a circumferential spline groove 36, and a receiving space for a polishing cloth 6 (FIG. 3) is provided therebelow. The edge of polishing cloth 6 is clamped by a rubber-elastic ring 37 which engages in the groove 36 thereby holding down the edge of polishing cloth 6. Finger openings 38 on lateral wall 34 help to remove the elastic ring 37 from spline groove 36 and to replace the polishing cloth 6 in this way, the latter being provided with magnetized ferromagnetic means on its underside for good support and adherence. It is preferred for the polishing bowl to be made of a plastic material. Polishing cloth 6 constitutes a carrier material onto which a polishing agent suspension is applied.

Figure 7:
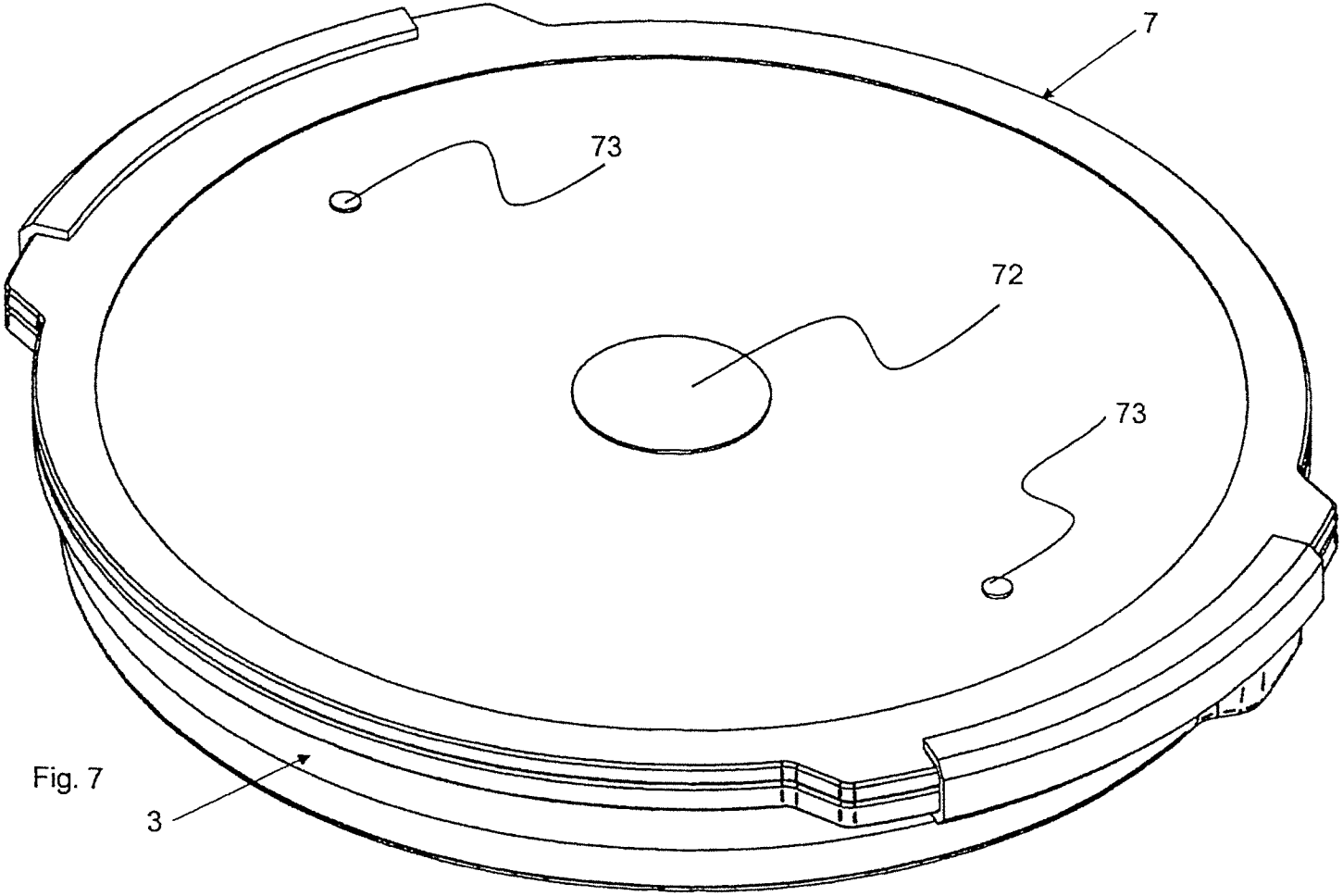
FIG. 7 is a perspective view from above of a lid for the polishing bowl.

The polishing bowl 3 can be closed with a lockable lid 7 (FIGS. 6, 7) so as to form a closable container for the polishing cloth and the polishing agent suspension. Lid 7 has projections 72 and 73 which fit into base wall recesses 32 and 33 of the polishing bowl, so that closed polishing bowls 3 (FIGS. 6, 7) can be stacked one above the other. It is contemplated to provide, together with a vibration polishing device, a plurality of such polishing bowls (FIGS. 6, 7) which may hold polishing agent suspensions of different granulation. In this way, the vibration polishing device can be used first as a fine grinding device for samples to be polished, and subsequently as a final polishing device.

Figure 3:
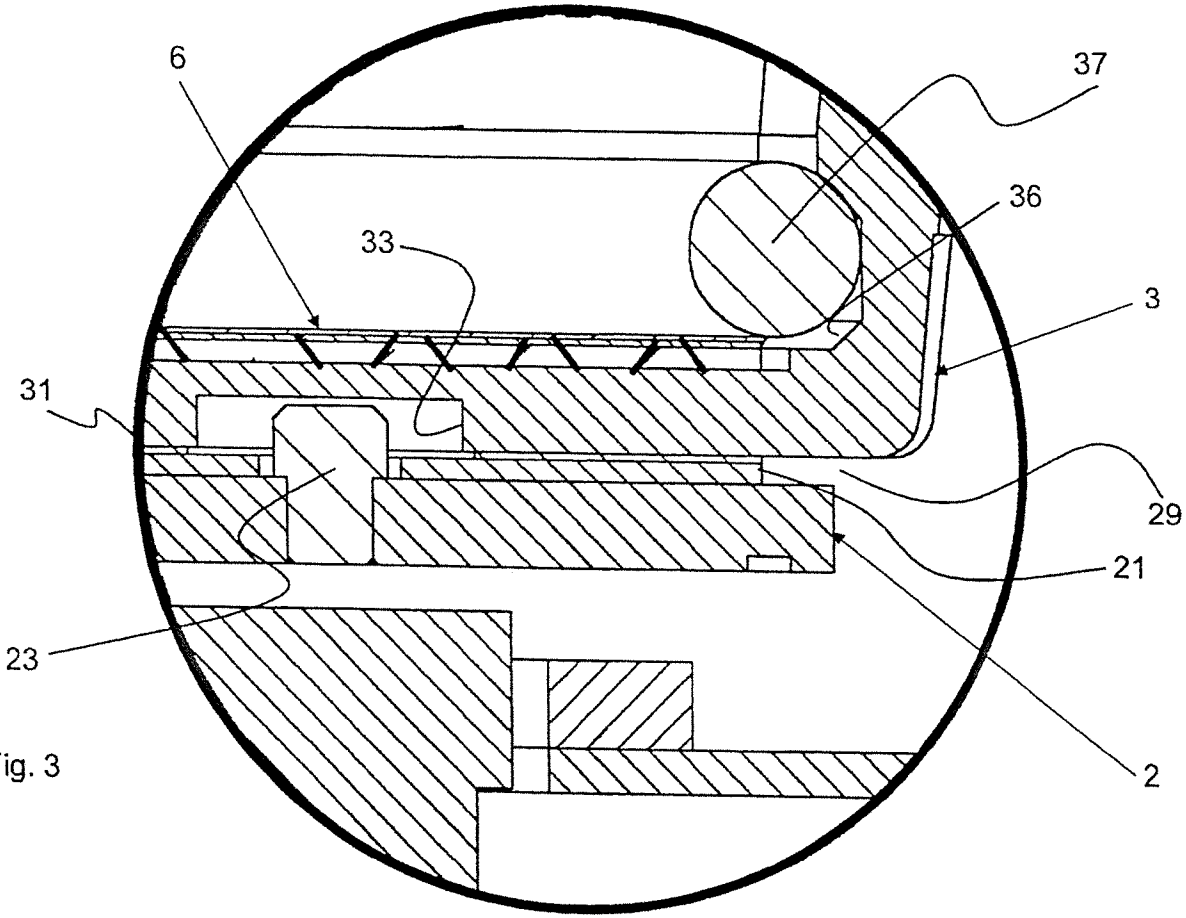
FIG. 3 shows an enlarged detail of FIG. 2.

As can be best seen in FIG. 3 between polishing disc 2 and polishing bowl 3, an edge gap 29 is provided, in which a tool can be engaged to gently lift the polishing bowl 3 from the polishing disc 2. The gentle lifting may be mechanized, for example by having a handle with a cam at the front end thereof engaging in the gap 29 (not shown), and the cam widening the gap 29 by turning the tool and thereby gently lifting the polishing bowl 3 from the polishing disc 2, against the magnetic adhesion force. It will also be sufficient to gently lift the polishing bowl by the handles 35.

As can be seen from FIG. 1, the vibration drive 1, the polishing disc 2, and the polishing bowl 3 form a first unit, which is arranged in the protective housing 5 next to the control unit 4 which forms a second unit. The protective housing 5 has an overall wedge-like shape with truncated wedge tip 51 in which the control unit 4 is accommodated. In the section of the truncated wedge tip 51, the upper side of the protective housing 5 is designed as a control panel and may include a touch screen 52. A housing hood 53 serves to cover the vibration polishing device.

Figure 8:
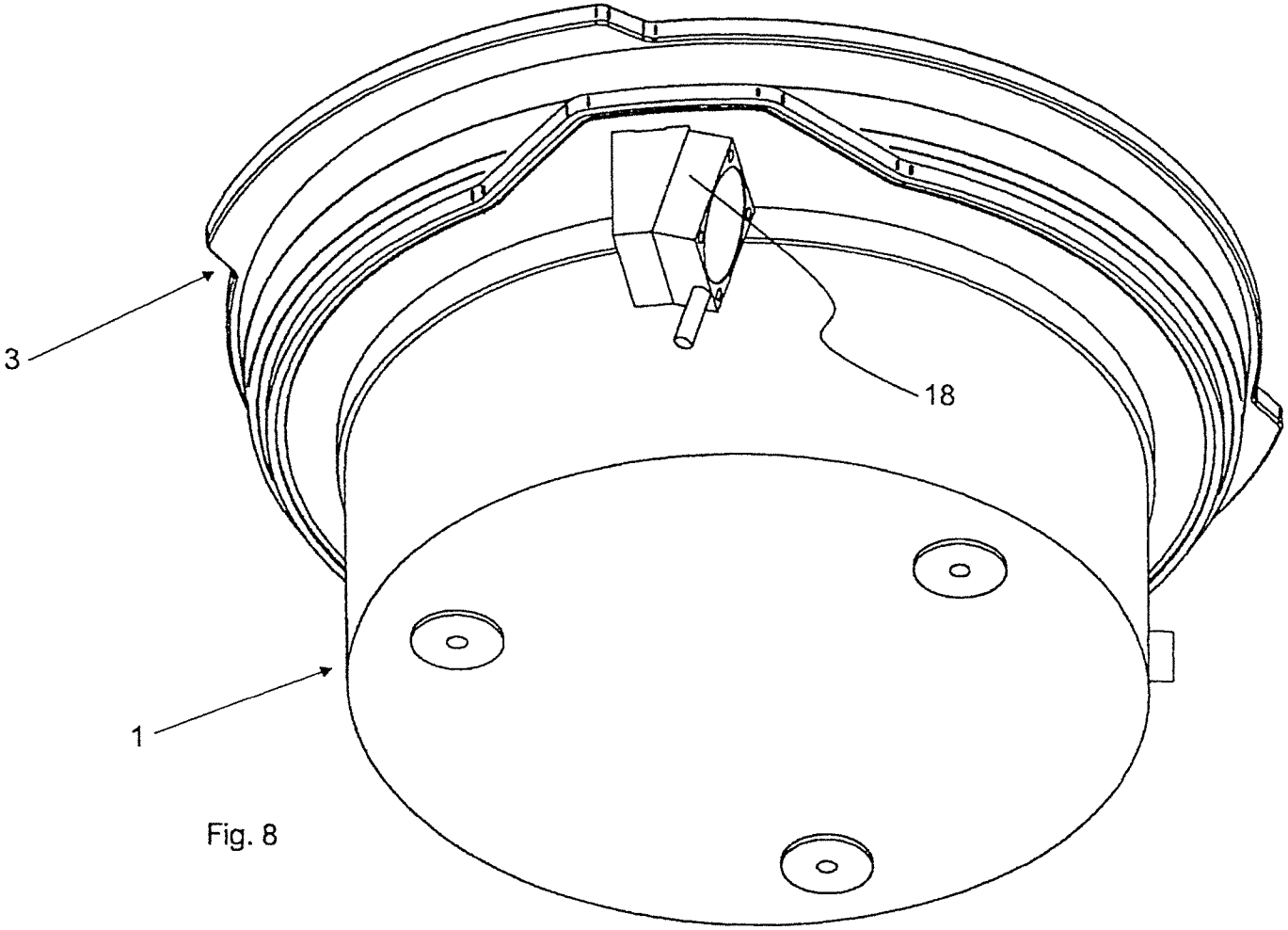
FIG. 8 is a perspective view of a vibration drive from below, with a polishing bowl placed thereon.

FIG. 8 shows the vibration drive 1 with the polishing bowl 3 placed thereon, and with an acceleration sensor 18 that is capable of measuring the accelerations between polishing disc 2 and polishing bowl 3 and of producing acceleration signals therefrom. These signals are fed back to the control unit 4 to control the voltage, current, and pulse output supplied to the vibration drive.

Figure 9:
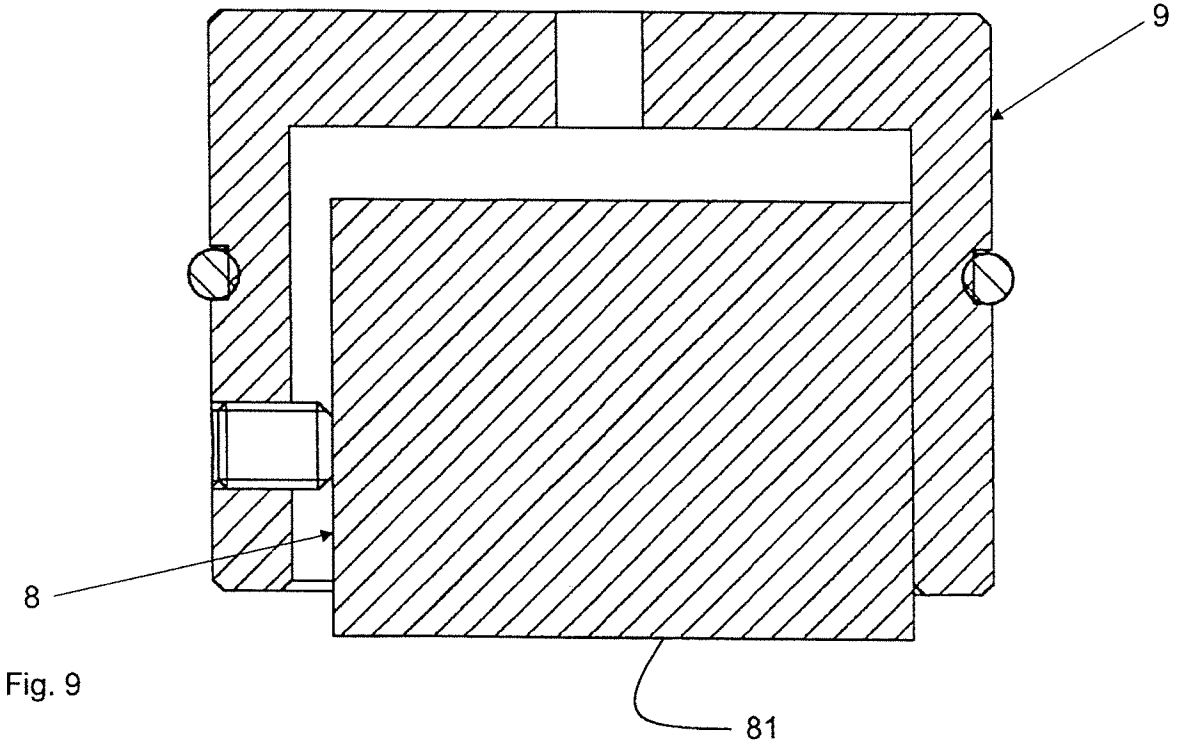
FIG. 9 is a sectional view of a sample holder.
Figure 10:
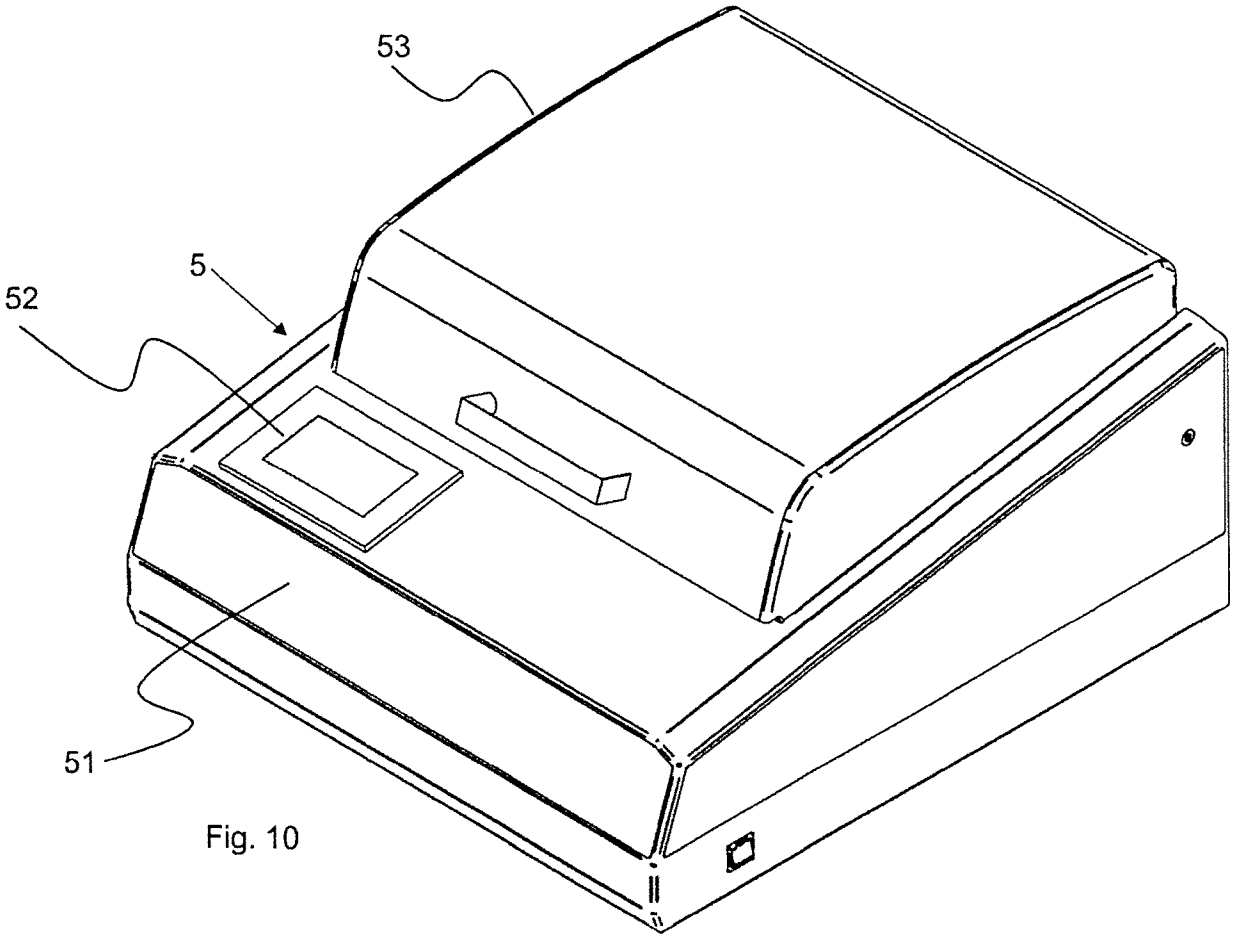
FIG. 10 is an overall perspective view of a vibration polishing device.

FIG. 9 shows a sectional view through a sample 8 and a sample holder, which can be used to appropriately clamp the sample 8 so that it can be placed with its underside 81 on the polishing cloth 6.

The operation of the vibration polishing device is as follows.

First, a plurality of samples 8 to be polished are prepared for the polishing process. In most cases this means that the samples are positioned in the sample holders 9 such that the surface 81 to be polished protrudes from the sample holder.

Control unit 4 is switched on to output electric currents of predetermined frequency and amperage to set the vibration drive 1 in motion. The vibrations generated on the vibration plate 13 are oscillating and cause the samples 8 to be polished and located in the polishing bowl to perform intermittent bouncing movements while being driven circumferentially in the polishing bowl 3. At each voltage surge, the first and second drive parts 14, 15 move relative to each other, and so does the counter-oscillating part 12 relative to the vibration plate 13, whereby the leaf springs 16 and 17 are tensioned, and when the voltage pulse drops the leaf springs 16 and 17 bring the device parts back into their starting position. Polishing disc 2 is firmly connected to the vibration plate 13 and therefore follows the movements thereof. However, this also applies to the polishing bowl 3, since the latter is entrained mechanically and/or magnetically. Indexing pins 25 prevent an unwanted rotational movement of the polishing bowl 3 relative to the polishing disc 2.

The described embodiment is to be considered by way of example. Various modifications are possible. It is well known that movements can be superimposed on each other. It is possible to provide two first drive parts and two second drive parts and to superimposed the movements generated thereby in order to promote the circulation of the samples to be polished in the pot-shaped polishing bowl. An even more favorable result can be achieved with three first and second drive parts.

It will be apparent to a person skilled in the art that the features, whether disclosed in the specification, the claims, the figures, or otherwise, may individually define essential components of the present disclosure, even if they are described together with other features.

The invention claimed is:

1. A vibration polishing device comprising:

a vibration drive comprising a base part, a counter-oscillating part, a vibration plate, a first drive part, and a second drive part;

wherein the base part and the counter-oscillating part are coupled by first leaf springs having their main planes grouped around a central axis in accordance with radial helical surfaces;

wherein the base part and the vibration plate are coupled by second leaf springs having their main planes grouped around the central axis in accordance with radial helical surfaces; and wherein the first drive part is arranged so as to be supported on the counter-oscillating part, and the second drive part is arranged so as to be supported on the vibration plate, for generating oppositely oscillating rotational oscillatory movements between the counter-oscillating part and the vibration plate when the vibration drive is in operation;

further comprising:

a polishing disc which is firmly connected to the vibration plate; and a polishing bowl which is adapted to receive a polishing medium and the samples to be polished and which is coupled to the polishing disc.

2. The vibration polishing device of claim 1, further comprising:

a control unit for power supply to the first and second drive parts in terms of voltage, current, and pulse formation; and an acceleration sensor which measures accelerations occurring when the device is in operation, on the counter-oscillating part and on the vibration plate and thus also onto the polishing disc and onto the polishing bowl and which generates acceleration signals based thereon, which are fed back to the control unit.

3. The vibration polishing device of claim 1, wherein the polishing medium comprises a carrier material and polishing agent.

4. The vibration polishing device of claim 3, wherein the carrier material is a polishing cloth and the polishing agent is provided in the form of a polishing agent suspension.

5. The vibration polishing device of claim 1, wherein the polishing bowl is coupled to the polishing disc so as to be detachable.

6. The vibration polishing device of claim 5, wherein the detachable coupling of the polishing bowl to the polishing disc is by magnetic holding force.

7. The vibration polishing device of claim 6, wherein ferromagnetic layers or parts are attached on the upper side of the polishing disc and on the underside of the polishing bowl.

8. The vibration polishing device of claim 5, wherein the polishing bowl is in the form of a plastic container for the carrier material and for the polishing agent suspension and can be closed with a lid and has a carrying handle to be placed on the polishing disc and lifted from the polishing disc as a closed container.

9. The vibration polishing device of claim 8, wherein closed containers are stackable one above the other.

10. The vibration polishing device of claim 9, wherein the polishing bowl has a central recess at its underside and the lid has a central projection on its upper side such that containers to be stacked one above the other can be fitted with their respective central recess onto the respective underlying projection.

11. The vibration polishing device of claim 1, wherein centering and/or indexing means are arranged between the polishing disc and the polishing bowl.

12. The vibration polishing device of claim 1, wherein the polishing bowl has a base wall with a receiving space for the polishing medium and a circumferential lateral wall with a groove for receiving a rubber-elastic ring which is adapted to clamp the edge of a polishing cloth that forms part of the polishing medium.

* * * * *